US010875328B2

(12) United States Patent
Rosenboom et al.

(10) Patent No.: US 10,875,328 B2
(45) Date of Patent: Dec. 29, 2020

(54) ASSEMBLY OF A GUIDING STRUCTURE AND A PRINT HEAD CARRIAGE

(71) Applicant: OCE HOLDING B.V., Venlo (NL)

(72) Inventors: Fabian T. Rosenboom, Venlo (NL); Wilhelmus H. J. Nellen, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 0 days.

(21) Appl. No.: 16/524,892

(22) Filed: Jul. 29, 2019

(65) Prior Publication Data

US 2020/0047527 A1 Feb. 13, 2020

(30) Foreign Application Priority Data

Aug. 10, 2018 (EP) ..... 18188394

(51) Int. Cl.

| | |
|---|---|
| ***B41J 25/00*** | (2006.01) |
| ***B41J 25/308*** | (2006.01) |
| ***B41J 19/14*** | (2006.01) |
| ***B41J 25/316*** | (2006.01) |
| *B41J 19/00* | (2006.01) |

(52) U.S. Cl.

CPC ..... *B41J 25/005* (2013.01); *B41J 19/142* (2013.01); *B41J 25/001* (2013.01); *B41J 25/003* (2013.01); *B41J 25/3086* (2013.01); *B41J 25/316* (2013.01); *B41J 19/00* (2013.01)

(58) Field of Classification Search

CPC .... B41J 25/005; B41J 25/003; B41J 25/3086; B41J 25/316; B41J 19/142; B41J 25/001

See application file for complete search history.

(56) References Cited

U.S. PATENT DOCUMENTS 10,464,357 B2 * 11/2019 Saiga ..... B41J 25/001
2004/0250760 A1 12/2004 Goto

FOREIGN PATENT DOCUMENTS

JP 6284601 B1 2/2008
JP 2008-62534 A 3/2008

OTHER PUBLICATIONS

Search Report issued in European priority application 18188394, dated Jan. 28, 2019.

* cited by examiner

*Primary Examiner* — Geoffrey S Mruk
(74) *Attorney, Agent, or Firm* — Birch, Stewart, Kolasch & Birch, LLP

(57) ABSTRACT

Described is an assembly of a guiding structure and a print head carriage, the print head carriage comprising a base carriage controllably movable relative to the guiding structure along a first horizontal axis, the print head carriage comprising a sub-carriage controllably movable relative to the base carriage along a second horizontal axis. The print head carriage comprises an intermediate carriage controllably movable relative to the base carriage along a vertical axis, the sub-carriage mounted on the intermediate carriage for moving together with the intermediate carriage relative to the base carriage, the sub-carriage controllably movable relative to the intermediate carriage along the second horizontal axis.

14 Claims, 7 Drawing Sheets

ASSEMBLY OF A GUIDING STRUCTURE AND A PRINT HEAD CARRIAGE

FIELD OF THE INVENTION

The present invention relates to an assembly of a guiding structure and a print head carriage.

BACKGROUND ART

A scanning-type inkjet printer comprises an inkjet print head mounted on a carriage guided to move along a certain axis by a guiding structure, to deposit swaths of ink droplets onto a recording medium moving relative to the guiding structure along an axis normal to the axis of carriage motion. By a recording medium being moved to advance over a certain distance in between different swaths, multiple swaths of ink droplets can be deposited side by side onto a recording medium so that the multiple swaths of ink droplets form a complete printed image.

In a known printer of the described type, the print head carriage comprises a base carriage controllably movable relative to the guiding structure along a first horizontal axis, wherein a print head is mounted on a sub-carriage controllably movable relative to the base carriage along a second horizontal axis. By a controlled motion of the sub-carriage relative to the base carriage, a position of the print head relative to the guiding structure can be adjusted, to correct for errors in the positioning of a recording medium relative to the guiding structure, or to compensate for inaccuracies in the guidance of the base carriage causing the base carriage to move to some extent along the axis of medium advance while moving along the axis of carriage motion.

The present invention aims to provide a more versatile assembly of a guiding structure and a print head carriage.

SUMMARY OF THE INVENTION

According to an aspect of the invention, in an assembly of a guiding structure and a print head carriage as described, the print head carriage comprises an intermediate carriage controllably movable relative to the base carriage along a vertical axis, the sub-carriage mounted on the intermediate carriage for moving together with the intermediate carriage relative to the base carriage, the sub-carriage controllably movable relative to the intermediate carriage along the second horizontal axis.

By the sub-carriage being mounted on an intermediate carriage, the intermediate carriage being controllably movable relative to the base carriage along a vertical axis and the sub-carriage being controllably movable relative to the intermediate carriage along the second horizontal axis, a print head mounted on the sub-carriage can be positioned not only at various distances from the guiding structure, but also at various heights above a supporting surface for supporting a recording medium. As a result, an assembly according to the invention can be used for printing on a range of recording media of various thicknesses, notably without the need of lifting a whole assembly of a guiding structure and a print head carriage to a certain height above a supporting surface as described.

BRIEF DESCRIPTION OF DRAWINGS

Other objects, features, and advantages of the present invention will become more apparent from the following detailed description when read in conjunction with the accompanying drawings, in which.

DETAILED DESCRIPTION OF EMBODIMENTS

Figure 1:
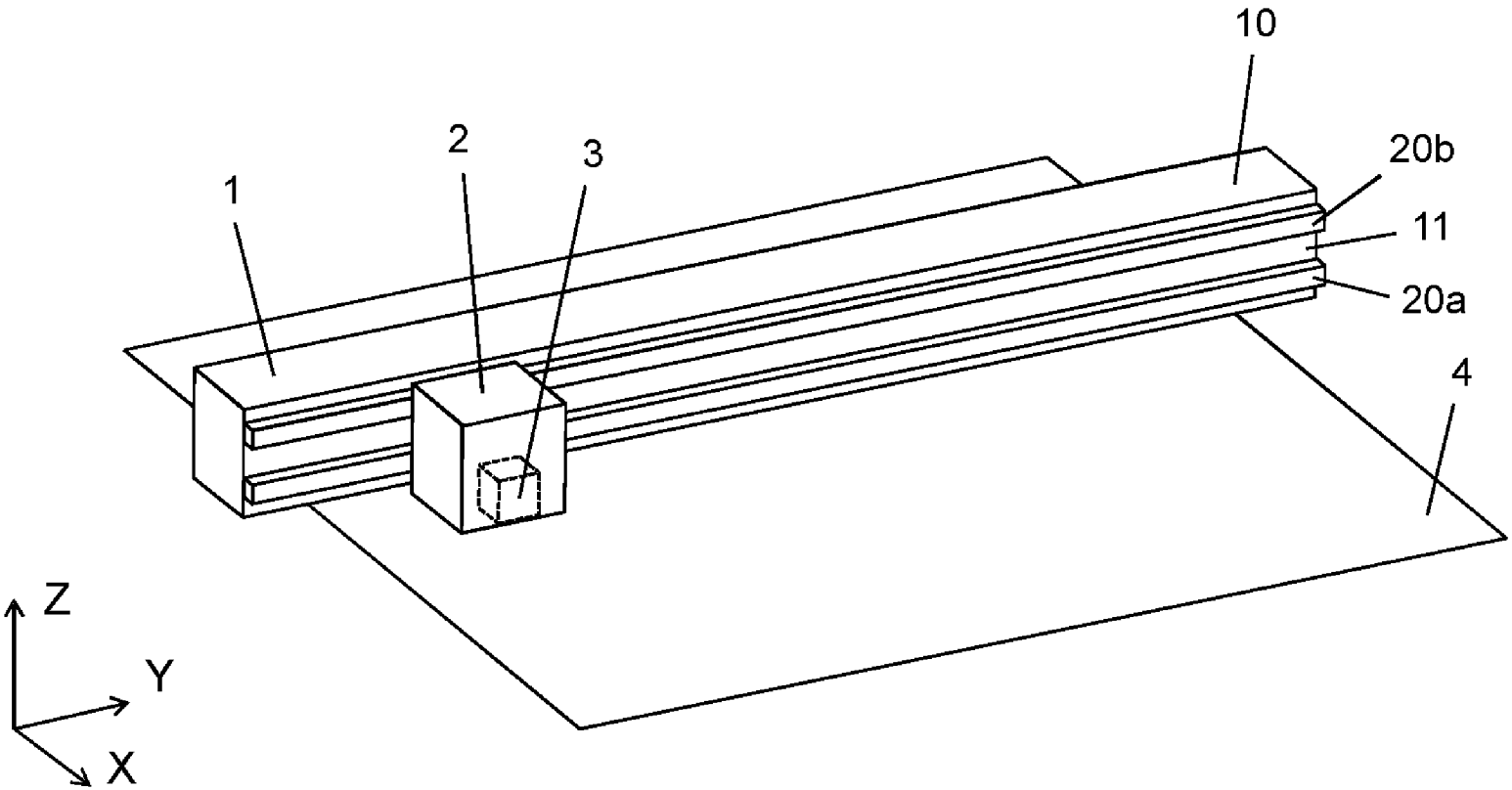
FIG. 1 shows a schematic perspective view of an assembly of a guiding structure and a print head carriage in a scanning-type printer, the print head carriage carrying a print head.

With reference to FIG. 1, a scanning-type inkjet printer comprises an inkjet print head 3 mounted on a print head carriage 2 arranged to move relative to a recording medium 4 along a first horizontal axis Y while being guided by a guiding structure 1.

Either the guiding structure 1 or the recording medium 4 is movably arranged in order for the guiding structure 1 and the recording medium 4 to be moved relative to each other along a second horizontal axis X normal to the first horizontal axis Y.

In operation, a swath of ink droplets is deposited onto the recording medium 4 by the print head 3 ejecting sequences of ink droplets towards the recording medium 4 while the print head carriage 2 is moving along the first horizontal axis Y, guided by the guiding structure 1.

In between the deposition of different swaths, the guiding structure 1 and the recording medium 4 are moved relative to each other along the second horizontal axis X, so that multiple swaths of ink droplets deposited onto the recording medium 4 can form a complete printed image.

In the shown embodiment, the guiding structure 1 comprises an elongated main part 10, oriented to extend along the first horizontal axis Y.

The guiding structure 1 further comprises a pair of primary guidance rails 20*a*, 20*b*, mounted above each other on a front face 11 of the main part 10 oriented orthogonally with respect to the second horizontal axis X. The primary guidance rails 20*a*, 20*b* extend in parallel to each other along the first horizontal axis Y, spaced apart along the vertical axis Z.

Figure 2:
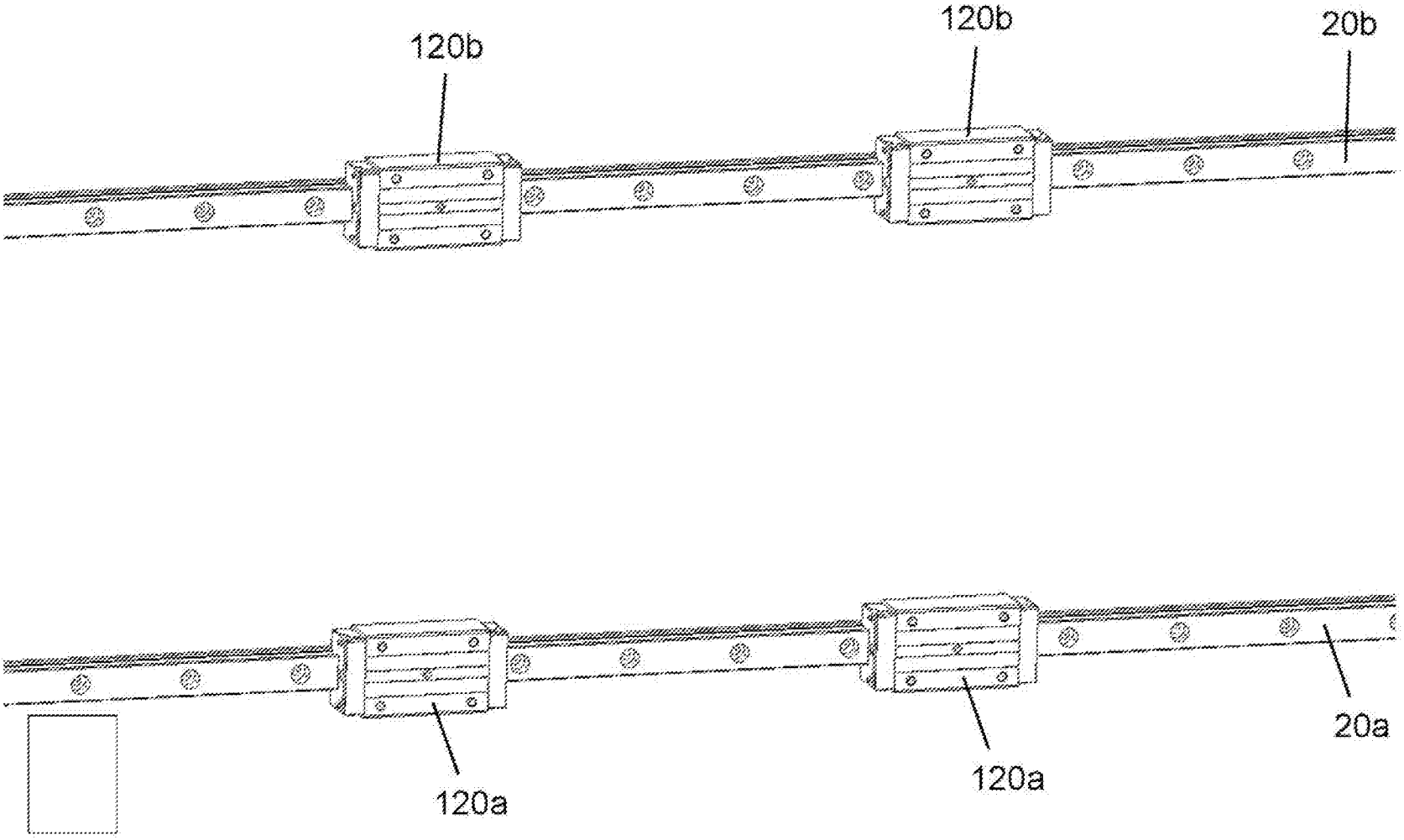
FIG. 2 shows a pair of guidance rails of the guiding structure of FIG. 1, a pair of runner blocks arranged on each guidance rail.

With reference to FIG. 2, a pair of primary runner blocks 120*a*, 120*b* is arranged on each of the primary guidance rails 20*a*, 20*b*.

Each primary runner block 120*a*, 120*b* is configured to slide along a respective primary guidance rail 20*a*, 20*b*, thereby being able to translate along the first horizontal axis Y.

Each primary runner block 120*a*, 120*b* engages a primary guidance rail 20*a*, 20*b* in such a way, that the translational degrees of freedom of the primary runner block 120*a*, 120*b* along the second horizontal axis X and the vertical axis Z and the rotational degrees of freedom of the primary runner block 120*a*, 120*b* about all of the three axes X, Y, Z are constrained relative to the rail 20*a*, 20*b*.

Figure 3:
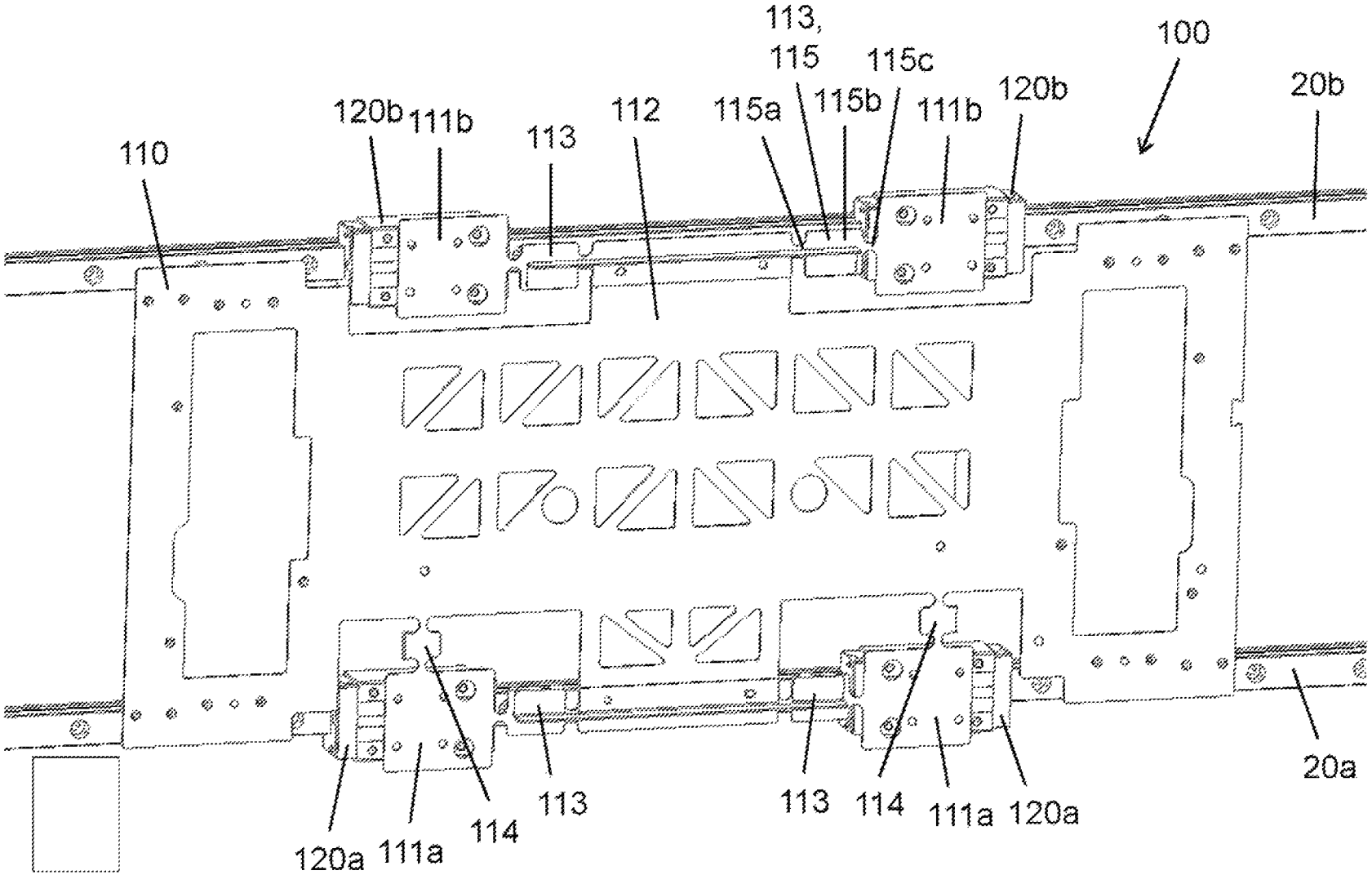
FIG. 3 shows a main plate of a base carriage.

With reference to FIG. 3, a base carriage 100 of the print head carriage 2 comprises a main plate 110 oriented orthogonally with respect to the second horizontal axis X, the main plate 110 having different plate sections 111*a*, 111*b* each positioned at a different one of the primary runner blocks 120*a*, 120*b*.

Each plate section 111*a*, 111*b* is connected to a main section 112 of the main plate 110 via one or more flexible bridges 113, 114, the flexible bridges 113, 114 allowing for a certain motion of a connected plate section 111*a*, 111*b* relative to the main section 112.

Each flexible bridge 113, 114 comprises a section 115 of the main plate 110 having a middle portion 115*b* of a certain width extending in between two end portions 115*a*, 115*c* of a reduced width. By the section 115 being able to flex about various axes, including an axis normal to the section 115 at each of the end portions 115*a*, 115*c*, a flexible bridge 113, 114 constrains on a limited scale only a translational degree of freedom along an axis extending from the one end portion 115*a* to the other end portion 115*c*, allowing plate sections 111*a*, 111*b*, 112 connected to the respective end portions 115*a*, 115*c* to move relative to each other in all other degrees of freedom, both translational and rotational.

In the shown embodiment, the plate sections 111*a* positioned at the primary runner blocks 120*a* arranged on the bottom primary guidance rail 20*a* are each connected to the main section 112 by a flexible bridge 113 extending along the first horizontal axis Y and a flexible bridge 114 extending along the vertical axis Z. A respective plate section 111*a* is thereby constrained relative to the main section 112 in translational degrees of freedom along the first horizontal axis Y and the vertical axis Z, and allowed to move relative to the main section 112 along the second horizontal axis X, as well as in all rotational degrees of freedom.

The plate sections 111*b* positioned at the primary runner blocks 120*b* arranged on the top primary guidance rail 20*b* are each connected to the main section 112 only by a flexible bridge 113 extending along the first horizontal axis Y. A respective plate section 111*b* is thereby constrained relative to the main section. 112 in a translational degree of freedom along the first horizontal axis Y, and allowed to move relative to the main section 112 along the second horizontal axis X and the vertical axis Z, as well as in all rotational degrees of freedom.

Figure 4:
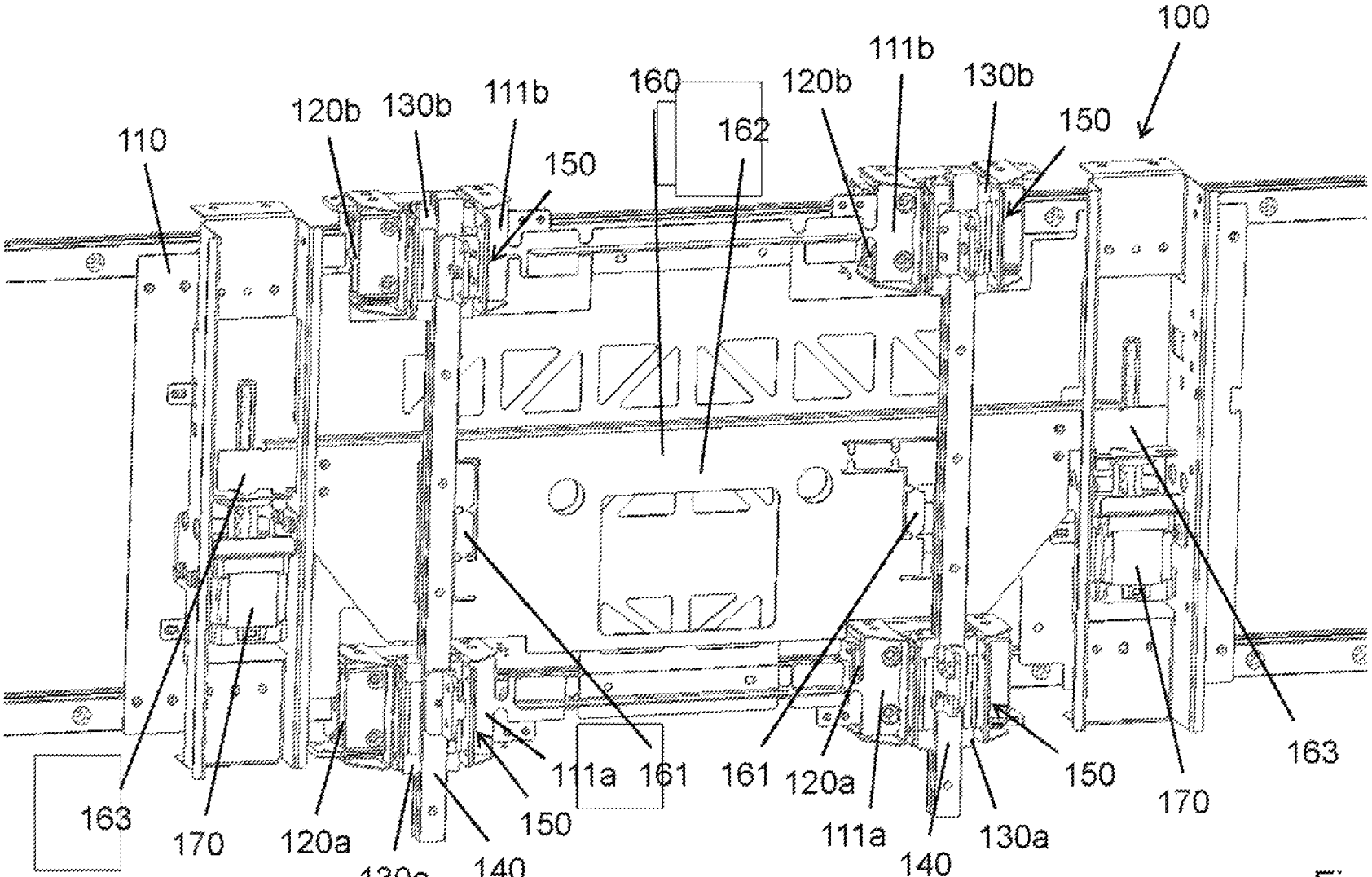
FIG. 4 shows two pairs of secondary runner blocks each mounted on one of the runner blocks of FIG. 2, a secondary guidance rail arranged to be guided by each pair of secondary runner blocks.

With reference to FIG. 4, the base carriage 100 further comprises two pairs of secondary runner blocks 130*a*, 130*b*, each secondary runner block 130*a*, 130*b* mounted on one of the primary runner blocks 120*a*, 120*b*, and two secondary guidance rails 140, each secondary guidance rail 140 arranged to be guided by a respective pair of the secondary runner blocks 130*a*, 130*b*.

Each pair of a secondary runner blocks 130*a*, 130*b* comprises one runner block 130*a* mounted on a primary runner block 120*a* arranged on, the bottom primary guidance rail 20*a*, and one runner block 130*b* mounted on a primary runner block 120*b* arranged on the top primary guidance rail 20*b*.

Each secondary guidance rail 140 is oriented along the vertical axis Z, and configured to slide along said vertical axis Z relative to a respective pair of secondary runner blocks 130*a*, 130*b* engaging the rail 140.

Each secondary runner block 130*a*, 130*b* engages a secondary guidance rail 140 in such a way, that the translational degrees of freedom of the guidance rail 140 along the two horizontal axes X, Y and the rotational degrees of freedom about all of the three axes X, Y, Z are constrained relative to the runner block 130*a*, 130*b*.

Each section 111*a*, 111 *b* of the main plate 110 positioned at a respective primary runner block 120*a*, 120*b* is fixed to the secondary runner block 130*a*, 130*b* mounted on that primary runner block 120*a*, 120*b*. By the different plate sections 111*a*, 111*b* having a certain freedom to move relative to the main section 112 of the main plate 110 as described, the main plate 110 is not overly constrained by the plate sections 111*a*, 111*b* being fixed, despite any inaccuracies in the alignment of the two primary guidance rails 20*a*, 20*b*, or any different amounts of thermal expansion between the main plate 110 of the base carriage 100 and the main part 10 of the guiding structure 1.

Each secondary runner block 130*a*, 130*b* is connected to a respective primary runner block 120*a*, 120*b* via a flexible structure 150, the flexible structure 150 allowing for a certain motion of the secondary runner block 130*a*, 130*b* relative to the primary runner block 120*a*, 120*b*.

Figure 5:
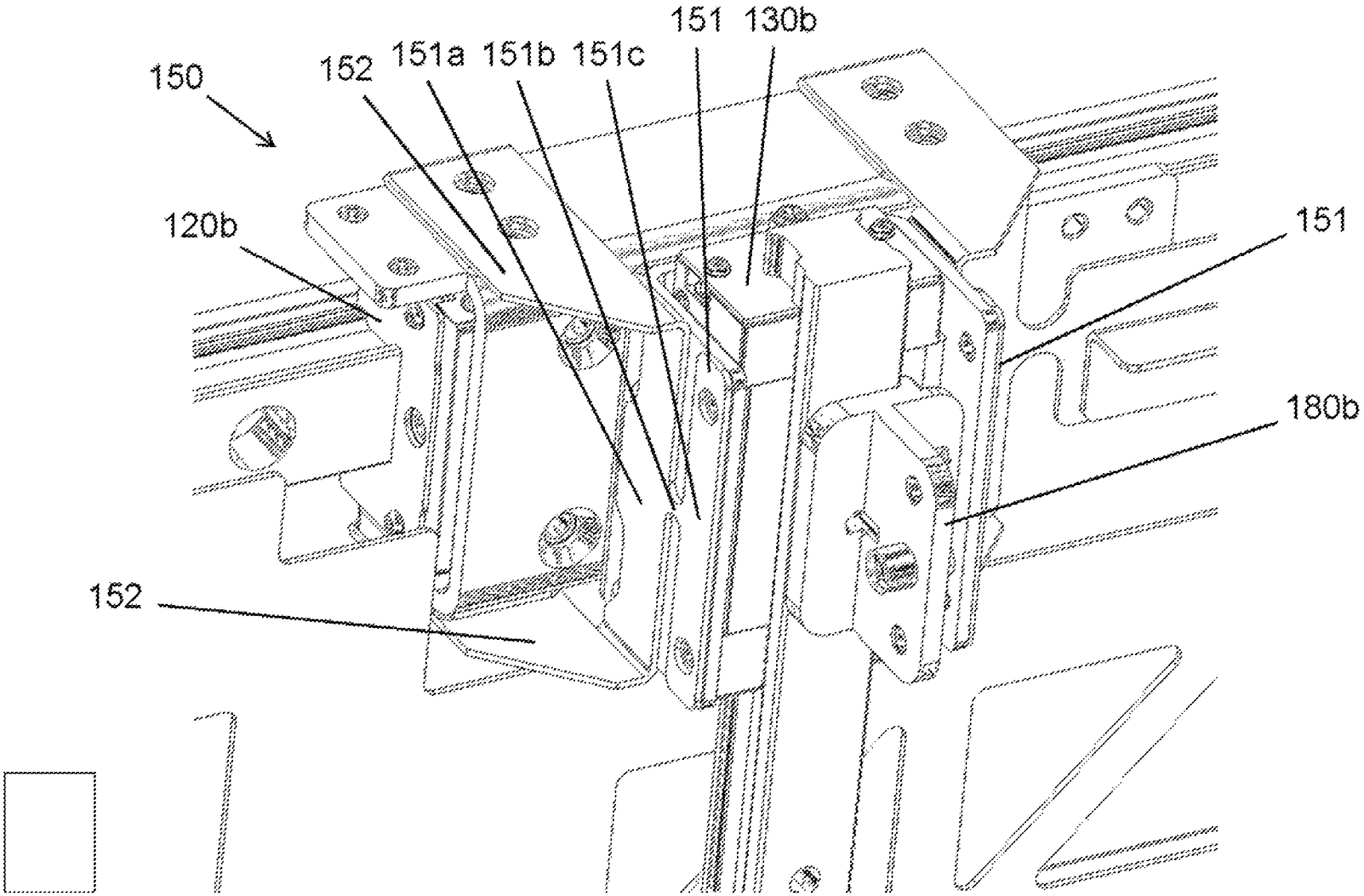
FIG. 5 shows in detail a structure flexibly connecting a secondary runner block to one of the runner blocks of FIG. 2, and a mounting element for mounting an intermediate carriage onto a secondary guidance rail.

With reference to FIG. 5, each flexible structure 150 comprises a pair of flexing plates 151 oriented orthogonally with respect to the first horizontal axis Y, each flexing plate 151 having a relatively thin middle portion 151*b* extending along the second horizontal axis X in between two wider end portions 151*a*, 151*c*. Each flexing plate 151 being able to flex about the first horizontal axis Y at the middle portion 151*b*, the pair of flexing plates 151, arranged on opposite sides of a secondary runner block 130*b* along the first horizontal axis Y, constrains such a secondary runner block 130*b* relative to the connected primary runner block 120*b* in respect of a translational degree of freedom along the second horizontal axis X while providing a rotational degree of freedom about the first horizontal axis Y.

One end portion 151*a* of each flexing plate 151 is connected to a primary runner block 120*b* via a pair of flexing plate sections 152 arranged at a top end and a bottom end of the end portion 151*a*, each flexing plate section 152 oriented orthogonally with respect to the vertical axis Z. Each flexing plate section 152 being able to flex about the first horizontal axis Y, each pair of flexing plate sections 152 connected to a flexing plate 151 allows a secondary runner block 130*b* fixed to the other end portion 151*b* of the flexing plate 151 to translate to a limited extent along the vertical axis Z relative to the primary runner block 120*b*.

The one end portion 151*a* of each flexing plate 151 being able to flex about the vertical axis Z relative to the flexing plate sections 152 arranged at the top end and the bottom end, a secondary runner block 130*b* fixed to the other end portion 151*b* is also allowed to rotate to some extent about the vertical axis Z relative to the primary runner block 120*b*.

The one end portion 151*a* of each flexing plate 151 being able to flex about the first horizontal axis X, a secondary runner block 130*b* fixed to the other end portion 151*b* is also allowed to translate to some extent along the first horizontal axis Y relative to the primary runner block 120*b*, and to rotate to some extent about the second horizontal axis X relative to the primary runner block 120*b*.

In summary, each flexible structure 150 constrains a secondary runner block 130*a*, 130*b* relative to a primary runner block 120*a*, 120*b* in respect of a translational degree of freedom along the second horizontal axis X, and provides the secondary runner block 130*a*, 130*b* with translational degrees of freedom relative to the primary runner block 120*a*, 120*b* along the first horizontal axis Y and the vertical axis Z, and rotational degrees of freedom relative to the primary runner block 120*a*, 120*b* about all three axes X, Y, Z.

By each flexible structure 150 allowing for a certain motion between a secondary runner block 130*a*, 130*b* and a respective primary runner block 120*a*, 120*b*, the secondary guidance rails 140 are not overly constrained by the secondary runner blocks 130*a*, 130*b* each being mounted on a respective primary runner block 120*a*, 120*b*, despite any inaccuracies in the mutual alignment of the two primary guidance rails 20*a*, 20*b* and/or the two secondary guidance rails 140.

With further reference to FIG. 4, the two secondary guidance rails 140 are mutually connected by a driving plate 160 extending in parallel to the main plate 110.

The base carriage 100 comprises a first pair of linear motors 170 each connected to a different end 163 of the driving plate 160 for driving said end 163 to move along the vertical axis Z relative to the main plate 110, the two linear motors 170 thereby being able also to drive the two secondary guidance rails 140 to move along the vertical axis Z relative to the main plate 110 together with the driving plate 160.

The two linear motors 170 having different positions along the first horizontal axis Y allows the two linear motors 170 also to tilt the driving plate 160 to some extent about the second horizontal axis X, by the linear motors 170 driving the different ends 163 of the driving plate 160 towards different positions along the vertical axis Z.

Limited tilting of the driving plate 160 about the second horizontal axis X is enabled by each secondary guidance rail 140 being connected to a main section 162 of the driving plate 160 by a flexible section 161 allowing the main section 162 to tilt about the second horizontal X relative to the respective guidance rail 140.

Figure 6:
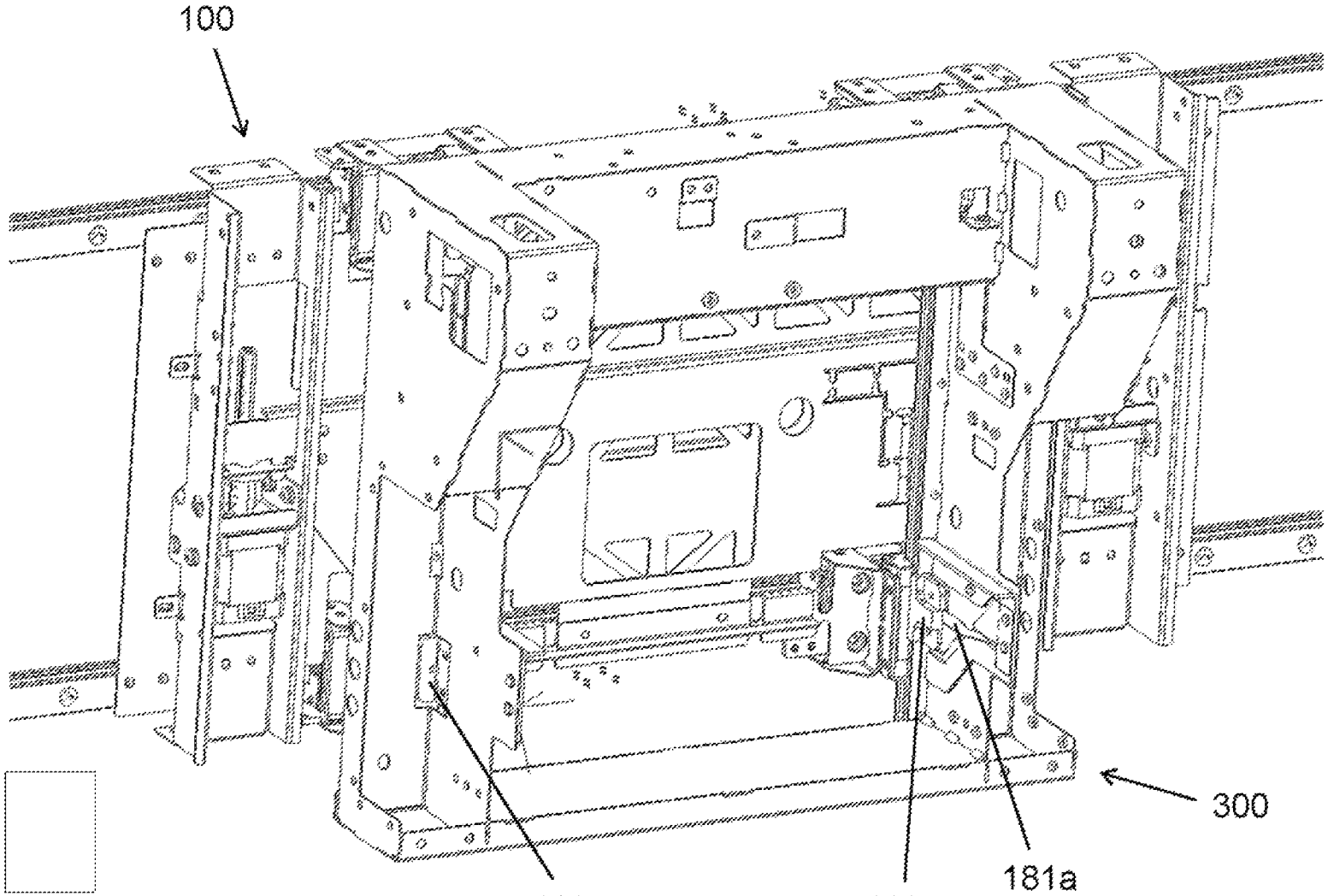
FIG. 6 shows an assembly of a base carriage and an intermediate carriage.

With further reference to FIG. 5 as well as FIG. 6, each secondary guidance rail 140 carries a pair of mounting elements 180*a*, 180*b* enabling an intermediate carriage 300 to be mounted onto the pair of secondary guidance rails 140, the mounting elements 180*a*, 180*b* spaced apart on each guidance rail 140 along the vertical axis Z.

Each upper mounting element 180*b* serves to hold a top end of a respective first leaf spring (not shown) connecting the intermediate carriage 300 to the base carriage 100, the first leaf spring having at least a portion extending along the vertical axis Z oriented orthogonally with respect to the first horizontal axis Y to allow a bottom end of the first leaf spring, fixed to a part of the intermediate carriage 300, to move along the first horizontal axis Y while a translation along the vertical axis Z is constrained.

Each lower mounting element 180*a* serves to hold a back end of a respective second leaf spring 181*a* connecting the intermediate carriage 300 to the base carriage 100, the second leaf spring 181*a* having at least a portion extending along the second horizontal axis X oriented orthogonally with respect to the vertical axis Z as well as a portion extending along the second horizontal axis X oriented orthogonally with respect to the first horizontal axis Y, to allow a front end of the second leaf spring, 181*a*, fixed to another part of the intermediate carriage 300, to move along both the first horizontal axis Y and the vertical axis Z while a translation along the second horizontal axis X is constrained.

A translation of the intermediate carriage 300 as a whole relative to the base carriage 100 along the first horizontal axis Y is constrained by a rod (not shown) connecting yet another part of the intermediate carriage 300 to the base carriage 100, extending along the first horizontal axis Y.

Being mounted as described, the intermediate carriage 300 is minimally constrained with respect to translations relative to the base carriage 100 along the first horizontal axis Y and the vertical axis Z, which allows for the intermediate carriage 300 and the base carriage 100 to be subject to different amounts of thermal expansion. At the same time, the intermediate carriage 300 is fixedly constrained with respect to a translation relative to the base carriage 100 along the second horizontal axis X, which allows for horizontal reaction forces resulting from the sub-carriage 200 being driven to move relative to the intermediate carriage 300 along the second horizontal axis X to be transferred, via the pair of secondary guidance rails 140, the secondary runner blocks 130*a*, 130*b*, the flexible structures 150, and the primary runner blocks 120*a*, 120*b*, to the guidance rails 20*a*, 20*b* and the main part 10 of the guiding structure 1.

Figure 7:
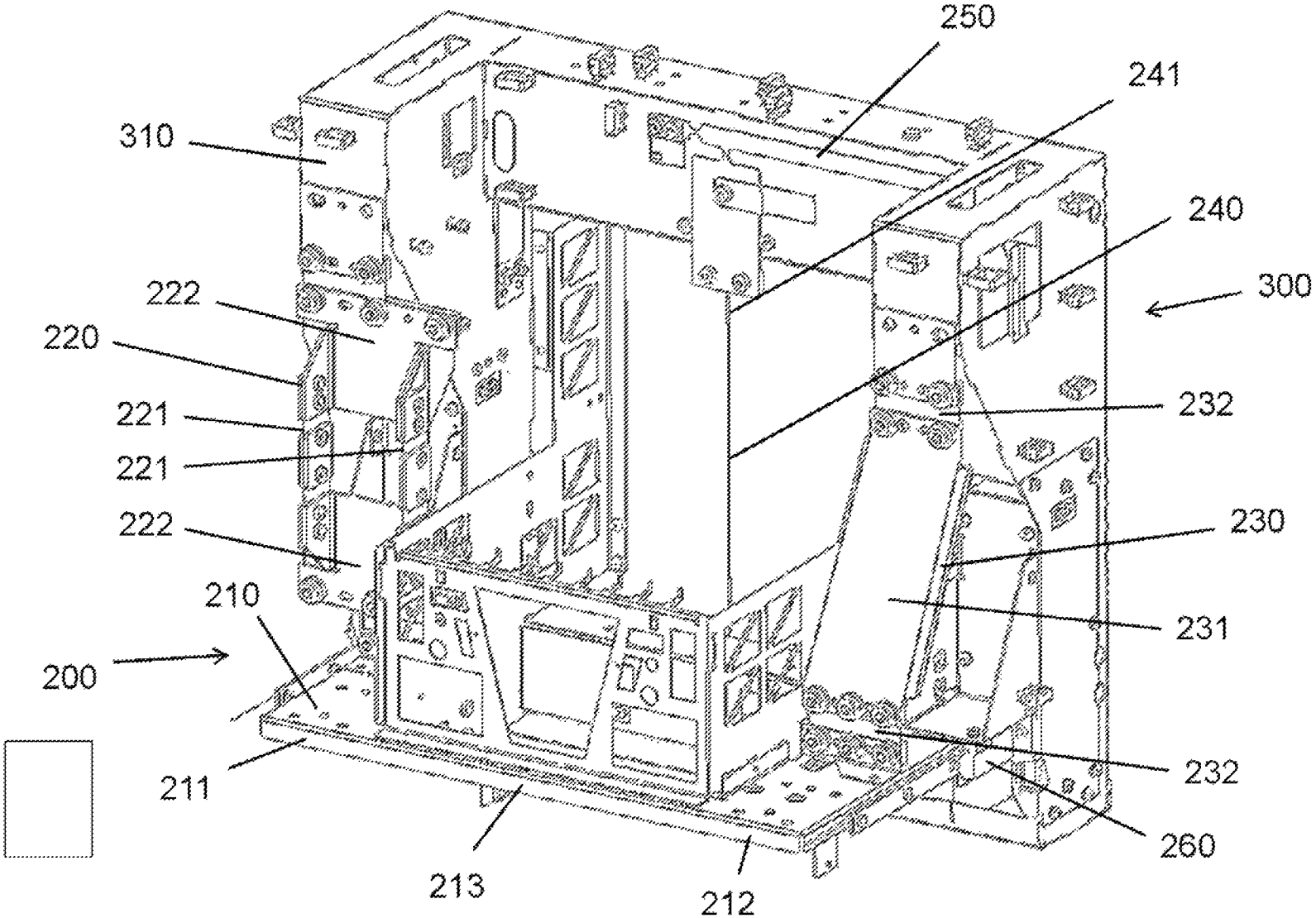
FIG. 7 shows an assembly of an intermediate carriage and a sub-carriage.

With reference to FIG. 7, a sub-carriage 200 mounted on the intermediate carriage 300 comprises a support plate 210 for supporting at least one print head, or a sub-structure carrying at least one print head, with a portion of the print head facing a recording medium 4, the support plate 210 horizontally oriented and arranged at a bottom of the sub-carriage 200.

The support plate 210 is connected to a main structure 310 of the intermediate carriage 300 via a pair of leaf spring structures 220, 230 extending along the vertical axis Z, the leaf spring structures 220, 230 spaced apart along the first horizontal axis Y and fixed to the support plate 210 at opposite ends 211, 212 thereof, on opposite sides of an area 213 for receiving a print head.

A leaf spring structure 220 connecting a first end 211 of the support plate 210 to the main structure 310 comprises a pair of leaf springs 221 oriented in parallel to each other orthogonally with respect to the first horizontal axis Y, and two leaf spring sections 222 oriented orthogonally with respect to the second horizontal axis X, each leaf spring section 222 connecting the pair of leaf springs 221 to one of the support plate 210 and the main structure 310. The pair of leaf springs 221 is configured to flex about the second horizontal axis X, providing the first end 211 of the support plate 210 with a translational degree of freedom relative to the main structure 310 along the first horizontal axis Y, thereby enabling the support plate 210 and the main structure 310 to be subject to different amounts of thermal expansion. The two leaf spring sections 222 are each configured to flex about the first horizontal axis Y, enabling the first end 211 of the support plate 213 to be moved along the second horizontal axis X.

A leaf spring structure 230 connecting the second end 212 of the support plate 210 to the main structure 310 comprises a relatively stiff middle section 231, and two leaf springs 232 oriented orthogonally with respect to the second horizontal axis X, each leaf spring 232 connecting the middle section 231 to one of the support plate 210 and the main structure 310. Each leaf spring 232 is configured to flex about the first horizontal axis Y, enabling also the second end 212 of the support plate 210 to be moved along the second horizontal axis X. The relatively stiff middle section 231 keeps the second end 212 of the support plate 210 fixed relative to the main structure 310 along the first horizontal axis Y.

The leaf spring structures 220, 230 together constrain a rotational degree of freedom of the support plate 210 about the second horizontal axis X.

A rotation of the sub-carriage 200 relative to the intermediate carriage 300 about the first horizontal axis Y is constrained by a flexible rod 240 connecting the support plate 210 to the main structure 310, extending along the vertical axis Z, positioned in between the two leaf spring structures 220, 230 along the first horizontal axis Y, and spaced apart with respect to the two leaf spring structures 220, 230 along the second horizontal axis X.

A top end 241 of the rod 240 is connected to a lever 250 mounted on the main structure 310 of the intermediate carriage 300, the lever 250 operable for accurately adjusting a position of said top end 241 along the vertical axis Z in order to control a rotational position of the support plate 210 about the first horizontal axis Y, the support plate 210 connected to the other end of the rod 240.

A position of each end 211, 212 of the support plate 210 along the second horizontal axis X can be adjusted by a second pair of linear motors 260, each linear motor 260 positioned on the main structure 310 and connected to one of the ends 211, 212 for driving the respective end 211, 212 to move relative to the main structure 310 along said axis X.

The two linear motors 260 having different positions along the first horizontal axis Y allows the two linear motors 260 also to rotate the support plate 210 to some extent about the vertical axis Z, by the linear motors 260 driving the different ends 211, 212 of the support plate 210 towards different positions along the second horizontal axis X.

Each linear motor 170, 260 may comprise a voice coil.

The translational degree of freedom along the vertical axis Z of the intermediate carriage 300 relative to the base carriage 100 allows an assembly 1, 2 as described to be used for printing on recording media of various thicknesses.

Before printing, by control of the first pair of linear motors 170, the intermediate carriage 300 is moved relative to the base carriage 100 in order to set a print head mounted on the sub-carriage 200 at a suitable height above a supporting surface for supporting a recording medium 4.

By control of the same motors 170, before printing, the sub-carriage 200 may also be tilted to some extent about the second horizontal axis X, in order to compensate for any inaccuracies in the assembly 1, 2 causing the print head not to be appropriately aligned with the supporting surface.

Aligning the sub-carriage 200 before printing may also comprise the tilting of the sub-carriage 200 about the first horizontal axis Y by control of the lever 250.

The translational degree of freedom along the second horizontal axis X of the sub-carriage 200 relative to the intermediate carriage 300 allows the position of a print head relative to the guiding structure 1 to be continuously corrected in order for the print head to follow a straight path. In parallel to the guiding structure 1, despite any inaccuracies in the main part 10 of the guiding structure 1 causing the guidance rails 20*a*, 20*b* not to be perfectly straight or aligned within a perfectly flat, vertical plane, oriented orthogonally with respect to the second horizontal axis X.

During printing, while the base carriage 100 moves along the guiding structure 1, the position of a print head mounted on the sub-carriage 200 is continuously adjusted by the second pair of linear motors 260 driving the sub-carriage 200 to move in a certain direction along the second horizontal axis X, enabled by the flexibility of the leaf spring structures 220, 230 connecting the sub-carriage 200 to the intermediate carriage 300.

A rotational position of the print head about the vertical axis Z may be adjusted at the same time, by the two linear motors 260 being controlled independently, for driving the two ends 211, 212 of the sub-carriage 200 to move at different speeds or in different directions along the second horizontal axis X.

In summary, in an assembly 1, 2 according to the invention, the base carriage 100, the sub-carriage 200 and the intermediate carriage 300 are constrained relative to each other in respect of some degrees of freedom, and configured to translate and/or rotate relative to each other in respect of other degrees of freedom. By operation of certain actuators 170, 250, 260, the position and/or orientation of certain carriages 100, 200, 300 relative to each other can be adjusted, in order to properly align a print head 3 with a recording medium 4 and/or with an axis of carriage motion Y. This enables certain parts of the assembly 1, 2, such as the main part 10 of the guiding structure 1, parts of the sub-carriage 200, and the main structure 310 of the intermediate carriage 300, to be assembled from relatively inaccurately shaped, but light-weight, and low-cost materials, such as sheet metal parts. Any inaccuracies can then be compensated for by appropriate adjustment of a relative position and/or orientation as described.

It is to be understood that the disclosed embodiments are merely exemplary of the invention, which can be embodied in various forms. Specific structural and functional details are not to be interpreted as limiting, but merely as a basis for the claims and as a teaching for one skilled in the art to variously employ the present invention in virtually any appropriately detailed structure. In particular, features presented and described in separate dependent claims may be applied in combination, and any advantageous combination of such claims is herewith disclosed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An assembly of a guiding structure and a print head carriage, the print head carriage comprising a base carriage controllably movable relative to the guiding structure along a first horizontal axis, the print head carriage comprising a sub-carriage controllably movable relative to the base carriage along a second horizontal axis, wherein the print head carriage comprises an intermediate carriage controllably movable relative to the base carriage along a vertical axis, the sub-carriage mounted on the intermediate carriage for moving together with the intermediate carriage relative to the base carriage, the sub-carriage controllably movable relative to the intermediate carriage along the second horizontal axis, and wherein the guiding structure comprises a pair of primary guidance rails extending along the first horizontal axis, a pair of primary runner blocks arranged on each guidance rail, the base carriage comprising a pair of secondary guidance rails extending along the vertical axis, each secondary guidance rail arranged to be guided by a pair of secondary runner blocks, each secondary runner block mounted on a respective one of the primary runner blocks.

2. The assembly according to claim 1, wherein the intermediate carriage is controllably tiltable relative to the base carriage about the second horizontal axis, the sub-carriage is controllably tiltable relative to the intermediate carriage about the first horizontal axis, and/or the sub-carriage is controllably rotatable relative to the intermediate carriage about the vertical axis.

3. The assembly according to claim 1, wherein each secondary runner block is connected to a respective primary runner block via a flexible structure.

4. The assembly according to claim 3, wherein the flexible structure constrains the secondary runner block relative to the primary runner block in respect of a translational degree of freedom along the second horizontal axis.

5. The assembly according to claim 3, wherein the flexible structure provides the secondary runner block with translational degrees of freedom relative to the primary runner block along the first horizontal axis and the vertical axis, and rotational degrees of freedom relative to the primary runner block about all three axes.

6. The assembly according to claim 1, the base carriage comprising a main plate having different sections each fixed to a different runner block, each plate section connected to a main section of the main plate via one or more flexible bridges allowing for a certain motion of a respective plate section relative to the main section.

7. The assembly according to claim 6, the main plate comprising two plate sections constrained relative to the main section in translational degrees of freedom along the first horizontal axis and the vertical axis, and two further plate sections constrained relative to the main section in a translational degree of freedom along the first horizontal axis and allowed to move relative to the main section along the vertical axis.

8. The assembly according to claim 6, wherein each plate section is fixed to a secondary runner block.

9. The assembly according to claim 1, wherein the intermediate carriage is minimally constrained with respect to translations relative to the base carriage along the first horizontal axis and the vertical axis, and fixedly constrained with respect to a translation relative to the base carriage along the second horizontal axis.

10. The assembly according to claim 1, comprising at least one leaf spring structure connecting the sub-carriage to the intermediate carriage, the leaf spring structure providing the sub-carriage with a translational degree of freedom relative to the intermediate carriage along the second horizontal axis.

11. The assembly according to claim 1, comprising at least one leaf spring structure connecting the sub-carriage to the intermediate carriage, the leaf spring structure providing an end of the sub-carriage with a translational degree of freedom relative to the intermediate carriage along the first horizontal axis.

12. The assembly according to claim 1, comprising two actuators for driving the intermediate carriage to move relative to the base carriage along the vertical axis, the two actuators having different positions along the first horizontal axis.

13. The assembly according to claim 1, comprising two actuators for driving the sub-carriage to move relative to the intermediate carriage along the second horizontal axis, the two actuators having different positions along the first horizontal axis.

14. A printer comprising the assembly according to claim 1.

* * * * *